US007625614B2

(12) United States Patent
Kamo et al.

(10) Patent No.: US 7,625,614 B2
(45) Date of Patent: Dec. 1, 2009

(54) ARTICLE, INK RECORDING MEDIUM, INK-JET RECORDING MEDIUM AND PRODUCTION PROCESS THEREOF

(75) Inventors: Hisao Kamo, Ushiku (JP); Masanori Ito, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 414 days.

(21) Appl. No.: 11/413,205

(22) Filed: Apr. 28, 2006

(65) Prior Publication Data

US 2006/0188671 A1 Aug. 24, 2006

Related U.S. Application Data

(63) Continuation of application No. PCT/JP2005/021625, filed on Nov. 18, 2005.

(30) Foreign Application Priority Data

Nov. 19, 2004 (JP) ..... 2004-336606

(51) Int. Cl.
*B41M 5/40* (2006.01)

(52) U.S. Cl. ..... 428/32.31; 428/32.17; 428/32.34

(58) Field of Classification Search ..... 428/32.17, 428/32.31, 32.34
See application file for complete search history.

(56) References Cited

U.S. PATENT DOCUMENTS

| | | | | |
|---|---|---|---|---|
| 5,181,935 | A * | 1/1993 | Reinert et al. | 8/442 |
| 5,635,291 | A | 6/1997 | Yoshino et al. | 428/304.4 |
| 5,800,916 | A | 9/1998 | Yoshino et al. | 428/328 |
| 5,846,647 | A | 12/1998 | Yoshino et al. | 428/328 |
| 5,851,654 | A | 12/1998 | Yoshino et al. | 428/328 |
| 5,955,185 | A | 9/1999 | Yoshino et al. | 428/304.4 |
| 5,962,124 | A | 10/1999 | Yoshino et al. | 428/328 |
| 5,965,252 | A | 10/1999 | Santo et al. | 428/329 |
| 6,342,289 | B1 | 1/2002 | Eguchi et al. | 428/195 |
| 6,461,417 | B1 * | 10/2002 | Malhotra et al. | 106/31.58 |
| 6,558,740 | B1 | 5/2003 | Santo et al. | 427/146 |
| 6,649,661 | B2 | 11/2003 | Yoshino et al. | 516/93 |
| 6,848,781 | B2 | 2/2005 | Ogino et al. | 347/105 |
| 2001/0014381 | A1 | 8/2001 | Kaneko et al. | 428/195 |
| 2002/0012629 | A1 | 1/2002 | Yoshino et al. | 423/625 |
| 2003/0186003 | A1 * | 10/2003 | Nakano et al. | 428/32.1 |
| 2004/0048008 | A1 | 3/2004 | Yoshino et al. | 428/32.1 |
| 2004/0246321 | A1 | 12/2004 | Takashima et al. | 347/100 |
| 2005/0007436 | A1 | 1/2005 | Ogino et al. | 347/105 |
| 2006/0182906 | A1 | 8/2006 | Kamo et al. | 428/32.34 |

FOREIGN PATENT DOCUMENTS

| | | |
|---|---|---|
| EP | 1 803 581 A1 | 7/2007 |
| JP | 7-232473 | 9/1995 |
| JP | 7-232475 | 9/1995 |
| JP | 8-132731 | 5/1996 |
| JP | 9-66664 | 3/1997 |
| JP | 9-76628 | 3/1997 |
| JP | 10-193779 | 7/1998 |
| JP | 2002-219857 | 8/2002 |
| JP | 2003-001931 | 1/2003 |
| JP | 2004-001354 | 1/2004 |
| JP | 2004-1354 | 1/2004 |
| JP | 2004-299373 | 10/2004 |

OTHER PUBLICATIONS

Polymer Degradation and Stability, 50 (1995), pp. 313-317.
Textile Praxis International, Oct. 1980, pp. 1213-1215.
Textile Chemist and Colorist, vol. 15 No. 4 (Apr. 1983), pp. 52-56.
Textile Progress, vol. 15 No. 3 (1987), pp. 16-24.
Nov. 14, 2008 Supplementary European Search Report in European Patent Appln. No. 05809107.5.

* cited by examiner

*Primary Examiner*—Betelhem Shewareged
(74) *Attorney, Agent, or Firm*—Fitzpatrick, Cella, Harper & Scinto

(57) ABSTRACT

An article has a constitution such that yellowing (e.g., yellowing of white portions upon storage in a resin file or the like) of the article can be continuously prevented over a long period of time even when it has a porous site composed of a pigment, such as an alumina hydrate, in an ink-receiving layer. An article, an ink recording medium and an ink-jet recording medium comprising a phenolic compound having a sulfonyl group and a diffusible sulfinic acid salt, and a production process of the ink-jet recording medium are provided.

5 Claims, No Drawings

ARTICLE, INK RECORDING MEDIUM, INK-JET RECORDING MEDIUM AND PRODUCTION PROCESS THEREOF

This application is a continuation of International Application No. PCT/JP2005/021625 filed Nov. 18, 2005, which claims the benefit of Japanese Patent Application No. 2004-336606 filed Nov. 19, 2004.

BACKGROUND OF THE INVENTION

1. Field of the Invention

The present invention relates to a technique for preventing yellowing of an article (a medium on which a photographic image is formed, a printing medium on which normal printing is performed, such as a label, or an elastic microporous substance or swellable microporous substance or an article partially having such a microporous substance) having a microporous site, and particularly to a recording medium, which can achieve high image quality suitable for ink recording using aqueous inks and has a novel anti-yellowing agent having anti-yellowing capability over a long period of time, and a production process and a storing method thereof. The present invention also relates to an ink-jet recording medium, which has a function of preventing yellowing on white portions upon storage in a file without impairing ink recording properties when a microporous site is comprised of an alumina hydrate and can exhibit anti-yellowing performance over a long period of time, to say nothing of a physical distribution and storage period during which it is transported overseas by marine transport after its production to be sold, a production process thereof, and a storing method suitable for the prevention of yellowing.

2. Related Background Art

Many ink-jet recording methods comprise ejecting fine droplets of a liquid (recording liquid) for recording, such as an ink, by various working principles to apply them to a recording medium having a microporous site, thereby printing images, characters and/or the like of high image quality, and printers using an ink-jet recording system have come to be extremely preferably used with the spreading of digital cameras, digital video cameras, scanners, personal computers and the like. An ink-jet recording medium is required to permit forming an image having high quick-drying property, excellent coloring of a colorant and high surface glossiness and resolution. As a recording medium capable of providing an image comparable with a silver salt photograph, an ink-jet recording medium using a fine inorganic pigment (silica, alumina or the like) and a binder thereof to provide, as an ink-receiving layer having a high voidrate, a microporous site in the form of a layer on a support is put to practical use.

Patent Document 1 describes that an alumina hydrate is preferred as a material for forming an ink-receiving layer because it has a positive charge, and so fixing of a dye in an ink is good to provide an image having excellent coloring. Among alumina hydrates, an alumina hydrate having a pseudoboehmite structure is more preferred because it has good dye adsorptivity, ink absorbency and transparency. However, when a recording medium provided with a porous layer as an ink-receiving layer is stored in a file after printing on the recording medium, white portions of the recording medium may be yellowed with time in some cases. In such a recording medium having the colorant-receiving layer of the porous structure, it is thus a very important property to prevent yellowing of the white portions. It is known that since the microporous site of the recording medium of such a structure as described above has a great number of fine voids, a phenolic antioxidant, typified by BHT (2,6-di-t-butyl-p-methylphenol), isolated from a resin-made file is adsorbed on the ink-receiving layer of the recording medium when the recording medium is stored in the file, and the phenolic antioxidant adsorbed on the microporous site is oxidized into a yellow oxide with time to cause yellowing. With respect to the yellowing caused by BHT, for example, Non-patent Documents 1, 2, 3 and 4 describe that the phenolic antioxidant is oxidized to form a quinone methide structure, and it is dimerized and further oxidized to produce a yellow compound having a stilbenequinone structure. Patent Document 2 describes a recording medium comprising a sulfur-containing organic acid compound having no mercapto group and a phenolic compound in an ink-receiving layer (containing silica) on a non-water-absorbing support. In this Patent Document, are mentioned sulfur-containing compounds such as thioether compounds, thiourea compounds, disulfide compounds, mercapto compounds, sulfinic compounds and thiosulfinic compounds, phenolic compounds, and hindered amines. However, it only describes those obtained by adjusting the surface pH of a receiving layer to 4.0 with an acid and adding a plurality of additives at the Example level. The yellowing-preventing effect by the Example is insufficient for preventing yellowing.

On the other hand, Patent Document 3 discloses an invention relating to a compound having a structure that a sulfine is connected to phenol, as a light-resisting agent and ozone resistance improver. This Patent Document mentions toluenesulfinic acid and benzenesulfinic acid as examples of general acids for adjusting the pH of ink-jet recording media. However, these acids are not used in Examples of ink-jet recording media having a pH of 3.5 though in a Comparative Example containing no compound according to the above-described invention, toluenesulfinic acid is used in place of this compound. It is clearly described that yellowing cannot be prevented according to the Comparative Example.

Patent Document 1: Japanese Patent Application Laid-Open No. 7-232475;

Patent Document 2: Japanese Patent Application Laid-Open No. 2002-219857;

Patent Document: Japanese Patent Application Laid-Open No. 2004-1354;

Non-patent Document 1: Polymer Degradation and Stability, 50 (1995), 313-317;

Non-patent Document 2: Textile Praxis International, October (1980), 1213-1215;

Non-patent Document 3: Textile Chemist and Colorist, April (1983), Vol. 15, No. 4, 52-56;

Non-patent Document 4: Text. Progr., 15 (1987), 16.

SUMMARY OF THE INVENTION

The present inventors have sought reasons why the yellowing-preventing effect cannot be technically exhibited as to the above-described prior art and further sought techniques necessary for continuously retaining the effect to grasp a phenomenon arising in recording media in a strong acid range and to secure a state capable of diffusing a sulfinic acid salt in a range of from weak acid to weak alkali, which can solve this phenomenon, thus leading to completion of the present invention.

It is accordingly a principal object of the present invention to provide a fundamental technique that permits preventing yellowing of all articles in a file (first object), continuously retaining the effect (second object) and preventing the yellowing of the articles over a long period of time. Specific examples of the articles include ink-jet recording media.

However, the articles are not limited thereto. In this embodiment, there is provided a yellowing-preventing technique that can simultaneously solve the prevention (first object) of yellowing of white portions when an ink-jet recording medium having an ink-receiving layer (containing alumina hydrate or silica particles as a pigment) equipped with a microporous site is stored in a file or the like after printing on the ink-receiving layer and the retention (second object) of the yellowing-preventing effect over a period corresponding to product life. A third object of the present invention is to provide an ink-jet recording medium that can solve securing a recording image density in ink recording (third object) as well as the first and second objects at the same time, and a production process of the recording medium and a storing method of articles, by which these properties can be surely realized.

The present inventors have carried out an investigation as to the above-described objects. As a result, attention has been paid to a reaction product of a quinone derivative, which is an oxide of a phenol derivative that may become the cause of yellowing upon adsorption on a microporous site, and a sulfinic compound, and its efficacy has been identified. This product has been an exemplary phenolic compound having a sulfonyl group according to the present invention. It has been found that the yellowing of white portions caused by BHT adsorbed on the receiving layer from the file is solved by containing this phenolic compound having the sulfonyl group together with a diffusible sulfinic acid salt in the ink-receiving layer. Here, it is inferred that the diffusible sulfinic acid salt (or sulfinic acid in a state kept at a pH of from 5.0 to 8.5) mainly brings about a continuous and long-term yellowing-preventing effect, and the phenolic compound having the sulfonyl group has a function of inhibiting a radical chain reaction in view of its structure, and that a yellowing reaction of a yellowing-causing substance typified by BHT is inhibited by capturing an active radical species generated in the process that the yellowing-causing substance is oxidized after the yellowing-causing substance is adsorbed on into the microporous site. Accordingly, the phenolic compound having the sulfonyl group preferably has a structure easy to release a hydroxy radical in a transition state or when the stability of a phenoxy radical is affected, and the phenol derivative is preferably substituted at an ortho-or para-position with an electron donating bulky functional group.

Accordingly, the present invention can solve the above-described problems and bring about particular effects on all articles (particularly, ink recording media) according to the following aspects. In particular, on ink-jet recording media, the retention of the effect of preventing yellowing on white portions upon storage in a resin file over a long period of time, and the retention of the yellowing-preventing performance in a physical distribution and storage period required for transporting them overseas by marine transport after their production can be achieved at the same time.

The present invention characterized above includes the following aspects.

(1) An article comprising a phenolic compound having a sulfonyl group and a diffusible sulfinic acid salt.

(2) An ink recording medium comprising an ink-receiving layer of a microporous structure formed on a support, wherein the ink-receiving layer has a phenolic compound having a sulfonyl group and a diffusible sulfinic acid salt.

(3) An ink-jet recording medium comprising an ink-receiving layer of a microporous structure formed on a support, wherein the ink-receiving layer has a phenolic compound having a sulfonyl group and a sulfinic acid salt, and the surface pH and internal pH of the ink-receiving layer are each from 5.0 to 8.5.

(4) The ink-jet recording medium according to the aspect (3), wherein the total amount of the phenolic compound and the sulfinic acid salt is from 1.5% by mass to 13.0% by mass based on an inorganic pigment making up the microporous structure.

(5) The ink-jet recording medium according to the aspect (3), wherein the total amount of the phenolic compound and the sulfinic acid salt is from 1.5% by mass to 7.0% by mass based on an inorganic pigment making up the microporous structure.

(6) A process for producing an ink-jet recording medium, which comprises the steps of forming an ink-receiving layer, which is a microporous substance, on a support, coating the ink-receiving layer with a coating liquid containing prescribed moles of a sulfinic compound, feeding a phenol derivative the number of moles of which is smaller than the number of moles of the sulfinic compound and causing a part of the sulfinic compound to react with the phenol derivative in the ink-receiving layer to form a sulfonic acid compound.

(7) The process according to the aspect (6) for producing the ink-jet recording medium, wherein the step of feeding the phenol derivative includes an oxidation step of oxidizing the phenol derivative in the ink-receiving layer after applying the phenol derivative to form a quinomethane type oxide.

(8) The process according to the aspect (6) for producing the ink-jet recording medium, wherein the step of feeding the phenol derivative is conducted by hermetically sealing the sulfinic-compound-containing recording medium within a closable film container composed of a polymeric material and containing the phenol derivative, feeding the phenol derivative to the ink-receiving layer through a gas phase within the container and then oxidizing the phenol derivative fed into the ink-receiving layer to form the quinomethane type oxide.

(9) The process according to any one of the aspects (6) to (8) for producing the ink-jet recording medium, wherein the ink-receiving layer is a pseudoboehmite layer formed by applying a coating liquid comprising an alumina hydrate and a binder.

(10) An article comprising a microporous site containing a reaction product of a sulfinic compound with a phenol derivative, and at least a diffusible sulfinic compound.

(11) An article comprising a microporous site containing at least one selected from a compound represented by the general formula (I) and a compound represented by the general formula (II), and a diffusible sulfinic compound, (I)

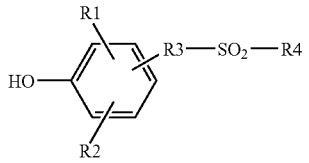

wherein R1 and R2 are individually hydrogen, a substituted or unsubstituted and linear, branched or cyclic alkyl group (having 1 to 30 carbon atoms), an alkoxy group (having 1 to 20 carbon atoms), a substituted or unsubstituted aryl group (having 6 to 30 carbon atoms), a mono-or di-substituted amino group (the substituent group(s) being an alkyl, acyl or alkenyl group having 1 to 20 carbon atoms), sulfide, disulfide, an amide group, an ester group, an alkenyl group, a hydroxyl group, or a substituted or unsubstituted ureido group (having 1 to 20 carbon atoms) and may form a bis form, with the proviso that both R1 and R2 are not hydrogen at the same time, at least one of R1 and R2, which is not hydrogen, is located at an o-position, and these functional groups may have an additional substituent, R3 is a substituted or unsubstituted and saturated or unsaturated alkylene group having 1 to 30 carbon atoms, a carbonyl group or a thiocarbonyl group, and R4 is a saturated alkyl, alkoxy or alkenyl group, a substituted or unsubstituted aryl group, or a substituted or unsubstituted aryloxy, alkylamino or amino group, with the proviso that these functional groups may be substituted by a hydroxy, amino, carboxyl, alkoxy, alkenyl or alkyl group, (II)

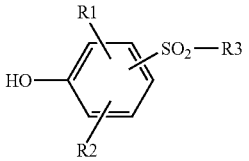

wherein R1 and R2 are individually hydrogen, a substituted or unsubstituted and linear, branched or cyclic alkyl group (having 1 to 30 carbon atoms), an alkoxy group (having 1 to 20 carbon atoms), a substituted or unsubstituted aryl group (having 6 to 30 carbon atoms), a mono-or di-substituted amino group (the substituent group(s) being alkyl, acyl or alkenyl group having 1 to 20 carbon atoms), sulfide, disulfide, an amide group, an ester group, an alkoxy group, an alkenyl group, a hydroxyl group, or a substituted or unsubstituted ureido group (having 1 to 20 carbon atoms) and may form a bis form, with the proviso that both R1 and R2 are not hydrogen at the same time, at least one of R1 and R2, which is not hydrogen, is located at an o-position, and these functional groups may have an additional substituent, and R3 is a saturated alkyl, alkoxy or alkenyl group, a substituted or unsubstituted aryl group, or a substituted or unsubstituted aryloxy, alkylamino or amino group, with the proviso that these functional groups may be substituted by a hydroxy, amino, carboxyl, alkoxy, alkenyl or alkyl group.

According to the aspect (1), the article comprises the phenolic compound having the sulfonyl group and the diffusible sulfinic acid salt, so that the effect of preventing yellowing of the article can be stably exhibited from the beginning over a long period of time, and the long-term retention of white portions in the article can be achieved. According to the aspect (2), the white color retaining effect of the medium itself subjected to ink recording can be exhibited, and the effect of preventing yellowing of white portions can be retained even when the ink recording medium is stored in a resin file for a long period of time after it is subjected to the ink recording. According to the pH range in the aspect (3), the sulfinic acid salt can be retained in a diffusible state, so that the performance of preventing yellowing caused in a physical distribution and storage period required until the ink-jet recording medium is transported overseas by marine transport after its production can be retained, and moreover the effect of preventing yellowing of white portions after printing can be retained. All the aspects (6) to (9) can provide a production process capable of efficiently producing a recording medium having the above-described effect of preventing yellowing of white portions. According to the aspect (4), by which the third object can be solved, an effect of suppressing the lowering of a print density is brought about in addition to the long-term and high-reliability yellowing-preventing effect. According to the aspect (5), storage of images over a long period of time and prevention of yellowing of white portions upon storage in a file can be achieved without lowing a print density and impairing print quality after printing, and so the yellowing-preventing effect is brought about both in a physical distribution and storage period and upon storage in a file. According to the aspects (10) and (11), articles excellent in the yellowing-preventing effect can be provided even when the articles have a porous portion.

DETAILED DESCRIPTION OF THE PREFERRED EMBODIMENTS

The articles (preferably, articles having a microporous site) according to the present invention comprise a phenolic compound having a sulfonyl group and a diffusible sulfinic acid salt. This phenolic compound having the sulfonyl group can be obtained by a reaction of a sulfinic acid salt having a yellowing-preventing effect with a quinomethane type oxide (hereinafter referred to as "quinomethane type derivative") obtained by oxidation of a phenol derivative. In particular, the yellowing-preventing effect can be effectively exhibited at a portion easy to be yellowed by containing the phenolic compound having the sulfonyl group and the diffusible sulfinic acid salt in a microporous site. When a sulfinic acid salt is contained in a diffusible state in the microporous site in advance, and a phenol compound, which is a yellowing-causing substance, is fed to the microporous site and oxidized, a quinomethane type derivative is formed, and this quinomethane type derivative reacts with the sulfinic acid salt to form the phenolic compound having the sulfonyl group. Yellowing is prevented through this reaction. Further, the phenolic compound having the sulfonyl group formed by this reaction also has an effect to reduce the phenol derivative by itself, and yellowing is more prevented by the reducing effect. In addition, since this compound is formed in the region from which the phenol derivative in the microporous site is fed, and remains there (undiffusible), it has an effect of blocking penetration of the phenol derivative into the microporous site. Further, since the sulfinic acid salt is dispersible, the yellowing-preventing effect is supplied by the sulfinic acid salt transferred from another site even when a compound having a structure derived from sulfinic acid and a quinone structure is consumed in the reduction of the phenol derivative, so that the continuity of the yellowing-preventing effect becomes more feasible.

Incidentally, the term "microporous site" as used in the present invention means that in the case of a layer structure, it may be a part thereof, to say nothing of the whole thereof. For example, in the case of an article composed of a plurality of microporous substances, the site means a part or the whole thereof, or a partial region which extends over a plurality of layers, but is not the whole.

The best mode of the present invention is an ink-jet recording medium comprising an ink-receiving layer composed of a microporous site, wherein the ink-receiving layer has the phenolic compound having the sulfonyl group and the diffusible sulfinic acid salt. In the present invention, the sulfinic acid salt is represented by a general formula (III).

General Formula (III)

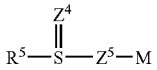

wherein $R^5$ is a substituted or unsubstituted and saturated aliphatic chain, a substituted or unsubstituted and unsaturated aliphatic chain, or a substituted or unsubstituted aryl or heteroaryl group, $Z^4$ is independently O, S, N—$R^6$ or N—$NR^7R^8$, $Z^5$ is oxygen or sulfur, M is a counter ion capable of offsetting the negative charge of $Z^5$, $R^6$ is a substituted or unsubstituted and saturated aliphatic chain, a substituted or unsubstituted and unsaturated aliphatic chain, or a hydroxyl group, and $R^7$ and $R^8$ are, independently of each other, a substituted or unsubstituted and saturated aliphatic chain, or a substituted or unsubstituted and unsaturated aliphatic chain.

Substituent groups in the case where $R^5$ are substituted are preferably electron-donating groups. As examples thereof, may be mentioned substituent groups such as alkyl, aryl, alkoxy, aryloxy, alkylthio, arylthio, arylsulfonyl, carbonamide, sulfonamide, ester, hydroxy, alkyloxy and aryloxy groups. One or more of these groups may substitute. These substituent groups may be bonded to each other to form a ring. These substituent groups may also form a part of a homopolymer or copolymer chain. Among the compounds represented by the general formula (III) are preferred methanesulfinic acid, ethanesulfinic acid, naphthalenesulfinic acid, p-toluenesulfinic acid, benzenesulfinic acid, 3-acetamido-4-methoxybenzenesulfinic acid, aminoethanesulfinic acid, and the like, in which both $Z^4$ and $Z^5$ are oxygen.

The quinomethane type oxide is an oxide of a phenol derivative, and the phenol derivative that is a reaction product of this oxide with a sulfinic compound preferably has a structure easy to release a hydroxy radical, and the phenol derivative is preferably substituted at an ortho-or para-position with an electron donating bulky functional group. The phenol derivative is more preferably substituted at an ortho-position with an electron donating functional group, i.e., a substituted or unsubstituted and linear, branched or cyclic alkyl group (having 1 to 30 carbon atoms), an alkoxy group (having 1 to 20 carbon atoms), a substituted or unsubstituted aryl group (having 6 to 30 carbon atoms), a mono-or di-substituted amino group (the substituent group(s) being alkyl or acyl group having 1 to 20 carbon atoms), an amide group, an ester group, an alkoxy group, an alkenyl group, a hydroxyl group, or a substituted or unsubstituted ureido group (having 1 to 20 carbon atoms), still more preferably a linear or branched alkyl group having 1 to 6 carbon atoms or an alkoxy group having 1 to 5 carbon atoms. These substituent groups may form a bis form with a divalent linking group having 1 to 5 carbon atoms. The functional group may also be a group having oxidation-preventing performance, such as sulfide, disulfide or alkenyl group. More preferably they form a bis form with a divalent linking group having 1 to 3 carbon atoms.

The phenol derivatives include hindered phenol used as stabilizers for resins. The hindered phenol has a structure easy to release a hydroxy radical, and it is inferred that its reaction product with the sulfinic compound has yellowing-preventing ability.

Preferable Examples 1 to 43 of the phenol derivative are described below.

1: 2,6-di-t-butylphenol,
2: 2,4-di-t-butylphenol,
3: 2-t-butyl-4-methoxyphenol,
4: 2-t-butyl-4,6-dimethylphenol,
5: 2,6-di-t-butyl-4-methylphenol,
6: 2,6-di-t-butyl-4-ethylphenol,
7: 2,4,6-tri-t-butylphenol,
8: 2,6-di-t-butyl-4-hydroxymethylphenol,
9: 2,6-di-t-butyl-2-dimethylamino-p-cresol,
10: 1,3,5-trimethyl-2,4,6-tris(3,5-di-t-butyl-4-hydroxy-benzylbenzene),
11: 3,9-bis[1,1-dimethyl-2-{β-(3-t-butyl-4-hydroxy-5-methylphenol)propionyloxy}ethyl]-2,4,8,10-tetraoxa-spiro[5,5]undecane,
12: n-octadecyl-3-(3',5'-di-t-butyl-4'-hydroxyphenyl) propionate,
13: 2,4-bis(n-octyno)-6-(4-hydroxy-3,5-di-t-butylanilino)-1,3,5-thiazoline,
14: 2-t-butyl-6-(3'-t-butyl-5'-methyl-2'-hydroxybenzyl)-4-methylphenyl acetate,
15: 2,2'-methylene-bis(4-methyl-6-t-butylphenol),
16: 2,2'-methylene-bis(4-ethyl-6-t-butylphenol),
17: 2,2'-methylene-bis(6-cyclohexyl-4-methylphenol),
18: 1,1,3-tris(2-methyl-4-hydroxy-5-t-butylphenyl)butane,
19: 2,2'-ethylidene-bis(2,4-di-t-butylphenol),
20: 2,2'-butylidene-bis(2-t-butyl-4-methylphenol),
21: 4,4'-methylene-bis(2,6-di-t-butylphenol),
22: 4,4'-butylidene-bis(3-methyl-6-t-butylphenol),
23: 1,6-hexanediol-bis[3-(3,5-di-t-butyl-5-methyl-(4-ydroxyphenol),
24: triethylene glycol-bis[3-(3-t-butyl-5-methyl-4-droxyphenyl) propionate,
25: N,N'-bis[3-(3-t-butyl-5-methyl-4-hydroxyphenyl)-propynyl]hydrazine,
26: N,N'-bis-3-(3',5')-di-t-butyl-4-hydroxyphenol,
27: propynylhexamethylenediamine,
28: 4,4'-thiobis(4-methyl-6-t-butylphenol),
29: 4,4'-thiobis(4-methyl-6-t-butylphenol),
30: 2,2'-thio-diethylene-bis[3-(3,5-di-t-butyl-t-butyl-4-hydroxyphenol)propionate],
31: bis[2-t-butyl-4-methyl-6-(3-t-butyl-5-methyl-2-hydroxy)phenyl]terephthalate,
32: 1,1,3-tris(2-methyl-4-hydroxy-5-t-butylphenylbutane,
33: 1,3,5-trimethyl-2,4,6-tris(3,5-di-t-butyl-4-hydroxy-benzyl)benzene,
34: tris(3,5-di-t-butyl-4-hydroxybenzyl)isocyanate,
35: tris[2-(3',5'-di-t-butyl-4-hydroxyhydrocinnamoyloxy-ethyl)isocyanate,
36: tris(4-t-butyl-2,6-dimethyl-3-hydroxybenzyl) isocyanate,
37: tetrakis[methylene-3-[3',5'-di-t-butyl-4'-hydroxy-phenyl]propionate]methane,
38: propyl-3,4,5-trihydroxylbenzene carbonate,
39: octyl-3,4,5-trihydroxylbenzene carbonate,
40: dodecyl-3,4,5-trihydroxylbenzene carbonate,
41: 2,2'-methylene-bis(4-m-ethyl-6-t-butylphenol),
42: 4,4-methylene-bis(2,6-di-t-butylphenol), and
43: 1,1-bis(4-hydroxyphenyl)cyclohexane.

A substituted or unsubstituted and saturated or unsaturated alkylene group having 1 to 30 carbon atoms which has high reactivity with the sulfinic acid salt is more preferred. Examples of more preferable compounds are described below. 2-t-Butyl-4,6-dimethylphenol, 2,6-di-t-butyl-4-methylphenol, 2,6-di-t-butyl-4-ethylphenol, 2,6-di-t-butyl-4-hydroxymethylphenol, n-octadecyl-3-(3',5'-di-t-butyl-4'-hydroxyphenyl) propionate, 2-t-butyl-6-(3'-t-butyl-5'-methyl-2'-hydroxybenzyl)-4-methylphenyl acetate, 2,2'-methylene-bis(4-methyl-6-t-butylphenol), 2,2'-methylene-bis(4-ethyl-6-t-butylphenol), 2,2'-methylene-bis(6-cyclohexyl-4-methylphenol), 2,2'-butylidene-bis(2-t-butyl-4-methylphenol), 4,4'-butylidene-bis(3-methyl-6-t-butylphenol), 4,4'-thio-bis(4-methyl-6-t-butylphenol), 2,2'-thio-diethylenebis[3-(3,5-di-t-butyl-t-butyl-4-hydroxyphenol) propionate], bis[2-t-butyl-4-methyl-6-(3-t-butyl-5-methyl-2-hydroxyl)phenyl]terephthalate, 2,2'-methylene-bis(4-m-ethyl-6-t-butylphenol), 4,4-methylene-bis(2,6-di-t-butylphenol) and 1,1,3-tris(2-methyl-4-hydroxy-5-t-butylphenyl)butane.

The reaction product of the quinomethane type derivative, which is the oxide of the phenol derivative, with the sulfinic compound is represented by the general formula (I) or (II), and a typical reaction of the quinomethane type derivative with the sulfinic compound is described below.

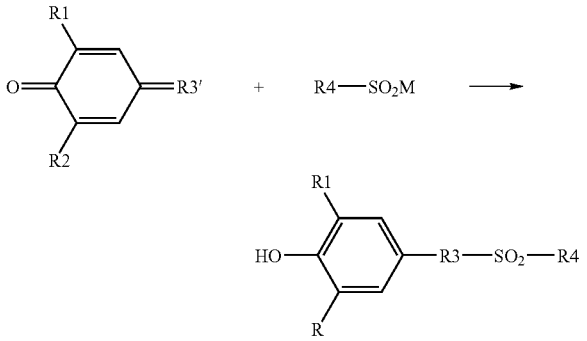

In the above-described reaction, the sulfinic compound and the phenol derivative are dissolved in a solvent, the solution is then subjected to an oxidation step to form the quinomethane type derivative, and this compound reacts with the sulfinic compound to obtain a phenolic compound having an alkylsulfonyl group. The reaction product of the sulfinic compound with the phenol derivative may also be obtained by dissolving the phenol derivative and the sulfinic compound in a solvent capable of dissolving both compounds, and then subjecting the solution to a oxidation reaction by introducing oxygen and an oxidation treatment using an oxidizing agent such as hydrogen peroxide. The oxidizing agent may be suitably selected. However, it is preferably colorless or white for the purpose of preventing discoloration upon addition of the reaction product to an ink-receiving layer.

The phenolic compound releases a hydroxy radical by the oxidation treatment to convert the site of R3 to R3' that is a carbocation, thereby obtaining the quinomethane type derivative. Then, the sulfinic acid electrically reacts with R3' to obtain the reaction product. The reaction is allowed to progress at ordinary temperature (25° C.). However, the solution is preferably refluxed at a reaction temperature not lower than 50° C. from the viewpoint of reaction efficiency.

However, the quinomethane type derivative, which is the oxide of the phenolic compound, may be often a yellow compound, and it is thus not preferable from the viewpoint of storage stability to put the compound liable to cause discoloration with time in an ink-receiving layer having a microporous substance. Accordingly, it is preferable to completely remove an unreacted remaining phenol derivative by means of distillation, separation chromatography or the like. On the other hand, the sulfinic compound is hard to cause a disadvantage such as discoloration with time unlike the remaining phenol derivative even when it is added to the ink-receiving layer, and so a remaining sulfinic compound may not be removed. Therefore, the reaction is conducted in a condition where the sulfinic compound is present in excess to the phenol derivative, whereby the unreacted phenol derivative can be prevented from remaining, and the reaction product can be added to the ink-receiving layer without removing the unreacted compound, so that the removal step can be omitted. Such reaction is thus preferred from the viewpoint of production efficiency. At this time, the molar ratio of the sulfinic acid to the phenol derivative is preferably higher than 1.0, more preferably from 10.0 to 200. In any event, the pH after the reaction is controlled to from 5.0 to 8.5, whereby "the coexisting state of the phenolic compound having the sulfonyl group and the diffusible sulfinic acid salt" according to the present invention can be simply created as the result of the reaction of the sulfinic compound with the phenol derivative of the less number of moles than the sulfinic compound. At the same time, the residue of the phenol derivative can be prevented from remaining.

Since the phenol derivative is relatively stable in an acid range of pH 5.0 or lower, and is hard to become the quinomethane type oxide, and so the reaction cannot be caused to sufficiently progress, the reaction is preferably conducted in a pH range near to neutrality for the purpose of efficiently obtaining the reaction product. The pH upon the reaction is preferably higher than 5.0, more preferably higher than 5.0, but not higher than 8.5. Further, since the sulfinic compound is unstable in structure in the case where the pH is lower than its dissociation pH and undergoes easy decomposition, the reaction is also preferably conducted around neutral range from the viewpoint of the stability of the sulfinic acid. A preferable pH upon the reaction is not lower than 3.0 from the viewpoint of stability of the sulfinic compound, and the pH is most preferably from 5.0 to 8.5 for the purpose of retaining the diffusible sulfinic acid salt.

The structure of the reaction product can be identified by means of NMR. The condition that the phenol derivative does not remain in the reaction product can be identified by means of high performance liquid chromatography. When the reaction product obtained by using the sulfinic compound in excess for the purpose of preventing the phenol derivative liable to be discolored with time from remaining is added to the ink-receiving layer composed of the microporous substance, the sulfinic acid becomes an unstable free acid when the surface and internal pHs of the receiving layer are low, so that a sulfinic compound is formed with time to lower the pH of the receiving layer. When the pH of the receiving layer is lowered by the formation of the sulfonic acid compound in a recording medium using, as a support, a water-absorbing support composed of paper, the support is deteriorated to cause the deterioration of long-term storage stability of the recording medium. When the pH of the receiving layer after printing is lowered with time, the deterioration of long-term storage stability of an image printed is caused. Therefore, the pH of the receiving layer is preferably not lower than the dissociation pH of the sulfinic compound from the viewpoint of the long-term storage stability. The pH of the receiving layer is preferably from 5.0 to 8.5, more preferably from 6.0 to 7.5.

The surface and internal pHs of the ink-receiving layer after the forming step of the ink-receiving layer may be adjusted by either adjusting the pHs of the coating liquids so as to give an optimum pH range or coating the ink-receiving layer with an alkali or acid after the forming step of the ink-receiving layer so as to give prescribed surface and internal pHs. The acid used in the adjustment of the pH may be either an inorganic acid such as nitric acid, sulfuric acid, hydrochloric acid or phosphoric acid or an organic acid such as succinic acid, maleic acid, acetic acid or formic acid. However, the acid is not limited thereto. Preferable example of the alkali include sodium hydroxide, potassium hydroxide and ammonia. However, the alkali is not limited thereto. The measurement of the surface pH is conducted in accordance with the Method A (coating method) among the surface and internal pH measurements prescribed by Japan Technical Association of the Pulp and Paper Industry (J. TAPPI). For example, a pH measuring kit (model MPC) for paper surface manufactured by KYORITSU CHEMICAL-CHECK Lab.

corresponding to the Method A may be used to measure the surface pH of the ink-receiving layer. The internal pH of the ink-receiving layer may be measured by using a microscope for a section produced by a microtome after the measurement of the surface pH. After a coating liquid of the measuring kit is applied to the ink-receiving layer for the measurement of the surface pH in accordance with the above-described method so as to completely penetrate into the ink-receiving layer, the section produced by the microtome is observed through the microscope to visually compare coloring levels within a range from a recording surface to the support with a color standard of the measuring kit, whereby the internal pH can be measured.

The ink-receiving layer equipped with the microporous site that is in "the coexisting state of the phenolic compound having the sulfonyl group and the diffusible sulfinic acid salt" according to the present invention can be formed in accordance with the following process.

The process comprises a step of forming an ink-receiving layer on a support and a step of coating the ink-receiving layer with a coating liquid comprising the reaction product of the sulfinic acid salt of a relatively great amount with the phenol derivative of a relatively small amount. A coating liquid comprising an alumina hydrate and a binder is applied on to the support to form a coating layer, and this coating layer is dried to provide the ink-receiving layer. This drying step is conducted for binding particles of the alumina hydrate contained in the coating liquid to one another with the binder to establish a porous structure having properties as the ink-receiving layer. The drying step is conducted under conditions of temperature, time and the like, which are required for the establishment of this porous structure. The drying temperature is preferably from 80° C. to 170° C., more preferably from 90° C. to 150° C. When a crosslinking agent for the binder is contained in the coating liquid, the binding function of the binder can be enhanced by this crosslinking agent to make the structure of the ink-receiving layer stronger. At the stage that the structure of the ink-receiving layer is established in such a manner, the coating liquid comprising the reaction product of the sulfinic compound with the phenol derivative is applied to add the reaction product into the ink-receiving layer. According to this process, the particles are fixed in the ink-receiving layer by the binder, so that the structure of the ink-receiving layer is retained without causing such aggregation of the sulfinic compound as described below from occurring. Since yellowing by sticking of BHT or the like is liable to occur in the vicinity of the surface of the ink-receiving layer, the coating liquid is preferably applied as an overcoat on the ink-receiving layer after the forming of the ink-receiving layer to distribute the reaction product of the sulfinic compound with the phenol derivative in the vicinity of the surface of the ink-receiving layer.

When the reaction product is added while the coating layer is in liquid form right after the application of the coating liquid for forming the ink-receiving layer or so, or at a stage that the desired porous structure is not established, the sulfinic compound remaining in the reaction product, the alumina hydrate and the sulfinic compound form a salt to cause aggregation of the alumina hydrate to change physical properties of the receiving layer by increase in pore diameter, and the like, thereby adversely affecting printing quality. Accordingly, both of the reaction product and the alumina hydrate are not contained in the same coating liquid.

After the step of forming the ink-receiving layer as a microporous site on the support, the sulfinic compound and the phenol derivative can be, independently of each other, fed to the ink-receiving layer to react them in the ink-receiving layer, thereby obtaining the reaction product represented by the general formula (I) or (II). Since the sulfinic compound is unstable in a state of a free acid, the coating liquid containing the sulfinic compound is preferably a solution of a sulfinic acid salt or a coating liquid in which a counter ion capable of forming a salt with sulfinic acid is present, and the sulfinic compound is present in an ionically dissociated state. When such a coating liquid is used to add the sulfinic compound to the receiving layer, the sulfinic compound is present in a state of a salt or an ionically dissociated and diffusible state in the receiving layer. The diffusible state means a state where the compound can freely diffuse within the ink-receiving layer formed by the microporous substance depending on an external factor such as humidity. Accordingly, the addition of the sulfinic compound to the ink-receiving layer may be conducted by applying a coating liquid containing the sulfinic compound after the forming of the ink-receiving layer, or applying the coating liquid to a support as a precoating liquid in a surface treating step, which will be described subsequently or immersing the support in a solution of the sulfinic compound before the forming of the ink-receiving layer when the support is water-absorbable.

As a preferred process for forming the ink-receiving layer containing the sulfinic compound there may be mentioned a process comprising the following steps.

Step A: a surface treatment step of applying a precoating liquid (containing no sulfur-containing organic compound);

Step B: a step of applying a coating liquid containing an alumina hydrate, a binder and a crosslinking agent;

Step C: a step of applying a coating liquid containing a sulfinic compound and a cation capable of forming a salt;

Step D: a step of applying a phenol derivative and

Drying step: a step of drying the coating liquids to form a receiving layer.

With respect to the application order, Step B may be conducted after completion of Step A and Step C, and any of Steps A and C may be conducted first. Alternatively, the sulfinic compound salt may be added to the precoating liquid in Step A to combine Steps A and C in one step. When Steps A and C are combined in one step, Step A may be conducted after Step C, and Steps A, C and B may be conducted by each one application. Further, coating liquids different in composition or coating liquid having the same composition may be applied in plural portions. Further, a coating liquid containing the sulfinic compound may be applied, and a coating liquid containing an ion to be a counter ion to the sulfinic compound and capable of forming a salt may be then applied as a substitutive step for Step C. The coating liquid containing the ion capable of forming the salt may be applied during steps prior to Step B or after the forming of the ink-receiving layer. Examples of the coating liquid capable of forming the salt include solutions of potassium hydroxide, sodium hydroxide and potassium carbonate. However, the coating liquid is not limited thereto.

After completion of all the coating steps, the step for drying the ink-receiving layer is conducted. A drying step may be provided between any steps as needed. However, the drying step for forming the ink-receiving layer is preferably provided right after the application in Step B because an adverse influence on the porous structure of the ink-receiving layer can be reduced. The drying temperature is preferably from 80° C. to 170° C., more preferably from 90° C. to 150° C. When the sulfinic compound is added to the ink-receiving layer whose surface and internal pHs are lower than the dissociation pH of the sulfinic compound, the sulfinic acid is easily decomposed at a temperature not lower than 50° C. to lower its yellowing-preventing effect. Therefore, the surface and internal pHs of the ink-receiving layer may preferably be controlled to pHs higher than the dissociation pH of the sulfinic compound and higher than 5.0. No particular limitation is imposed on the pHs of the coating liquids in Step C and Step A containing the sulfur-containing compound salt. However, the pHs are preferably from 4.0 to 11.0, more preferably from 6.0 to 10.

The surface treatment step for the support is Step A of applying the precoating liquid containing the binder and the crosslinking agent for causing a crosslinking reaction to cure the binder and may be conducted as needed. The application of the crosslinking agent is preferred from the viewpoint of making stronger the desired structure of the ink-receiving layer of the porous structure mainly formed from the alumina hydrate in the ink-receiving layer. The surface treating step A is a step of applying the precoating liquid containing the binder and the crosslinking agent for causing a crosslinking reaction, which is a step of coating the support with the precoating liquid that is a coating liquid containing at least one selected from the group consisting of boric acid and boric acid salts. The precoating liquid is an aqueous solution containing the crosslinking agent and preferably contains the crosslinking agent in a proportion of from 1% by weight to 10% by weight.

When Steps A and C are combined in one step, or the application in Step A is conducted after the application in Step C, boric acid and/or the boric acid salt in the precoating liquid of Step A can easily penetrate to prevent the occurrence of cracking after the forming of the ink-receiving layer. Therefore, such procedure is advantageous from the viewpoints of yield and production efficiency.

The surface treating step is a step of conducting coating on a water-absorbable support and then applying the coating liquid for forming the ink-receiving layer in a state that the surface of the base material is retained in a certain degree of wetting state (may be a coated state or a thickened state) without drying the surface of the base material. In order to improve the coating ability of the precoating liquid, a surfactant, alcohol or the like may be added to the precoating liquid to adjust a surface tension and water absorbing capacity. The amount of the precoating liquid applied in the surface treating step is from 0.05 $g/m^2$ to 3.0 $g/m^2$ in terms of the solid content of boric acid and/or the boric acid salt.

The sulfinic compound and the cation capable of forming the salt may also be additionally fed to the ink-receiving layer formed by the above-described process by an overcoating system. At this time, an overcoating liquid may be preferably adjusted to a concentration not adversely affecting printing quality to apply it. In this case, a salt of the sulfinic compound comes to be fed to the surface of the ink-receiving layer, so that the concentration of the sulfinic compound salt becomes high in an ink-fixing region when the sulfinic compound is used at a high concentration, thereby easily causing deterioration of the printing quality, such as lowering of print density. Accordingly, a coating liquid, in which the concentration of the sulfinic compound salt is adjusted to 10% by weight or lower, particularly preferably from 1% by weight to 8% by weight, is preferred for achieving a good print density.

The sulfinic compound and the substance capable of forming the salt with the sulfinic compound are present in a dissolved state in the coating liquid used in Step C. The ratio of the cation to the sulfinic compound or thiosulfonic compound in the coating liquid is preferably 1.0 or higher. Solvents usable for dissolving the organic acid and the cation capable of forming the salt may be any solvent so far as the organic acid can be dissolved therein. The solvent is preferably ion-exchanged water, methanol, ethanol or the like, and more preferably ion-exchanged water. However, the solvent is not limited thereto. The use of a coating liquid obtained by dissolving the organic acid salt and other additives such as a hindered amine which will be described subsequently, at the same time, in a mixed solvent of water-based and solvent-based plural solvents combined with each other is preferable from the viewpoint of improvement in production efficiency. No limitation is imposed on the pH of the coating liquid of the organic acid salt dissolved in the solvent. However, it is preferably from 4.0 to 11.0, more preferably from 6.0 to 10. Solvents usable for dissolving the phenol derivative therein may be any solvent so far as the phenol derivative is dissolved therein. Moreover, a solvent capable of dissolving the sulfinic acid salt therein is preferred. The reason for it is that these compounds are easy to be uniformly mixed in the ink-receiving layer. Specifically, the solvent is preferably methanol, ethanol or the like.

Step D of feeding the phenol derivative will be described. The phenol derivative is higher in storage stability than the unstable quinomethane type derivative, and is rapidly oxidized into the quinomethane type derivative within the ink-receiving layer to form the reaction product with the sulfinic compound when the surface and internal pHs of the ink-receiving layer are from 5.0 to 8.5 that is a preferable range as described above at the time the phenol derivative has been fed to the ink-receiving layer. Accordingly, it is preferable from the viewpoint of quality control in production that the phenol derivative is used in place of the addition of the quinomethane type derivative to the receiving layer. The sulfinic compound is present in a state of salt or in an ionically dissociated state when the surface and internal pHs of the ink-receiving layer fall within the above-described range, and is diffusible depending on external factors such as humidity. The sulfinic compound is present in a diffusible state within the microporous site, i.e., in a state of salt or in an ionically dissociated diffusible state, whereby the phenol derivative and the sulfinic compound can be reacted with each other even when both compounds are separately fed. When the phenol derivative is applied to the receiving layer having the diffusible sulfinic compound at this time, both compounds react with each other to consume the sulfinic compound. Diffusible sulfinic compounds present about the consumed sulfinic compound diffuse so as to form a uniform distribution to continuously conduct the reaction, thereby forming a reaction product. Therefore, even when the sulfinic compound and phenol derivative are separately applied, no unreacted phenol derivative remains. It is inferred that the reaction product according to the present invention can be fed to the ink-receiving layer owing to the self-diffusing effect of the sulfinic acid.

The reaction product of the sulfinic compound with the phenol derivative can be contained in the formed ink-receiving layer by conducting a heat treatment in the presence of oxygen after feeding the sulfinic compound and phenol derivative. The heating temperature is preferably 50° C. or higher. However, since the phenol derivative may be gasified in some cases when it is exposed to a high temperature, so that the reaction product required for the prevention of yellowing may not be obtained by reduction of the phenol derivative in the ink-receiving layer, the reaction may also be conducted in the condition of being hermetically sealed within a closable film container having oxygen permeability. As the film container, is preferred that having an oxygen transmission rate of from 0.05 $ml/m^2 \cdot 24hr \cdot atm \cdot 20°$ C.·65% RH to 180 $ml/m^2 \cdot 24hr \cdot atm \cdot 20°$ C.·65% RH, preferably from 1.0 $ml/m^2 \cdot 24hr \cdot atm \cdot 20°$ C.·65% RH to 120 $ml/m^2 \cdot 24hr \cdot atm \cdot 20°$ C.·65% RH. The oxygen transmission rate can be measured in accordance with the equal pressure method prescribed in JIS K7126 B and the differential pressure method prescribed in JIS K7126 A. Examples of a preferred material for the film container include films of PET, nylon, polyolefins and the like having gas permeability. A multi-layer film obtained by laminating these films may also be used, or a film obtained by vapor-depositing a metal such as aluminum or an oxide such as silica may also be preferably used.

The amount of the sulfinic compound remaining in the formed ink-receiving layer can be qualitatively and quantitatively determined by means of HPLC as to an extract obtained by immersing the ink-receiving layer after its forming for 10 minutes in ion-exchanged water of 25° C. The phenol derivative in the receiving layer and the amount of the phenol derivative remaining therein can be qualitatively and quantitatively determined by means of HPLC as to an extract obtained by immersing the ink-receiving layer for 10 minutes in a solvent capable of dissolving the derivative therein, such as ethanol or methanol. They may also be qualitatively and quantitatively determined by means of headspace GC/MS with the ink-receiving layer. The reaction product may also be qualitatively and quantitatively determined by means of HPLC as to an extract obtained by immersing the ink-receiving layer for 10 minutes in a solvent capable of dissolving the derivative therein, such as ethanol or methanol.

Phenol derivatives preferably used in the present invention include those capable of being gasified at room temperature or higher and fed to the ink-receiving layer through a gas phase. Since such a phenol derivative is oxidized in the gas phase into the quinomethane type derivative while being adsorbed on the receiving layer through the gas phase, the feeding method through the gas phase is effective from the viewpoint of production efficiency. Examples of the phenol derivative suitable for feeding through the gas phase include, not limited thereto, low-molecular weight phenol derivatives such as 2,4-di-t-butylphenol, 2-t-butyl-4-methoxyphenol, 2-t-butyl-4,6-dimethylphenol, 2,6-di-t-butyl-4-methylphenol, 2,6-di-t-butyl-4-ethylphenol and 2,6-di-t-butyl-4-hydroxymethylphenol.

These phenol derivatives may be blended with a polymeric material having gas permeability, and a recording medium equipped with a receiving layer containing the sulfinic compound is hermetically sealed within a container composed of a film formed from this polymeric material and heated and stored, thereby causing the phenol derivative to be adsorbed on the microporous layer in the ink-receiving layer through the gas phase and then causing the quinomethane type derivative obtained by oxidation within the film container and the sulfinic compound to react with each other. The storing temperature at this time is preferably at least room temperature (about 25° C.), and 50° C. or higher is more preferred because the various reactions can be efficiently conducted. Since yellowing is caused with time when the phenol derivative is adsorbed in excess to the sulfinic compound at this time, it is preferable that the sulfinic compound be added to the ink-receiving layer in excess to the phenol derivative in the polymeric material. The molar ratio of the sulfinic acid to the phenol derivative is preferably higher than 1.0, more preferably from 10.0 to 400. The phenol derivative in the polymeric material can be qualitatively and quantitatively determined by means of headspace GC/MS. The sulfinic compound and the reaction product of the sulfinic acid with the phenol derivative can be qualitatively and quantitatively determined by analysis using HPLC as to the above-described extract, whereby the molar ratio of the sulfinic acid to the phenol derivative, and the amount of the reaction product can be determined. Also, the extract can be evaluated by means of NMR, thereby identifying the structure of the reaction product.

The sulfinic compound can be stored in a soft packaging container composed of the above-described film, thereby obtaining the reaction product of the sulfinic compound with the phenol derivative in the ink-receiving layer. This storage permits the recording medium equipped with the ink-receiving layer containing the reaction product to have the ability to prevent subsequent yellowing caused by a phenolic antioxidant typified by BHT. The recording medium equipped with the ink-receiving layer containing the sulfinic acid to be stored may be either before or after printing. The soft packaging container preferably has oxygen permeability when the recording medium is hermetically stored because the phenol derivative fed to the ink-receiving layer through the gas phase requires to be oxidized. Such a container preferably has a transmission rate of from 0.05 $ml/m^2 \cdot 24hr \cdot atm \cdot 20°$ C.·65% RH to 180 $ml/m^2 \cdot 24hr \cdot atm \cdot 20°$ C.·65% RH, more preferably from 1.0 $ml/m^2 \cdot 24hr \cdot atm \cdot 20°$ C.·65% RH to 120 $ml/m^2 \cdot 24hr \cdot atm \cdot 20°$ C.·65% RH. The oxygen transmission rate can be measured in accordance with the equal pressure method prescribed in JIS K7126 B and the differential pressure method prescribed in JIS K7126 A.

The sulfinic compound in the ink-receiving layer is preferably contained at a molar ratio of from 1 to 400 to a phenolic antioxidant or the like contained per unit area of a resin file. The sulfinic compound is more preferably contained at a molar ratio of from 10 to 100. The content of the phenolic antioxidant per unit area of the resin file can be determined by means of headspace GC-MS.

When silica (generally, silica itself does not fix a colorant, but forms a microporous substance) is used as a pigment used in the ink-receiving layer to cause the ink-receiving layer to have sufficient ink-fixing ability, it is essential to add a cationic polymer for fixing the colorant in addition to silica. It is necessary to set the ink-receiving layer to a pH of about 4.5 for the purpose of causing the polymer to have cationicity. However, such setting is not preferred from the viewpoint of stable retention of the sulfinic compound or thiosulfonic compound salt from the above-described reason. When an alumina hydrate is used to form the ink-receiving layer on the other hand, the sulfinic compound is in a diffusible state when the sulfinic compound and phenol derivative are separately added to the ink-receiving layer, because the alumina hydrate exhibits effective ink-fixability even at a pH not lower than the dissociation pH of the sulfinic compound or thiosulfonic compound salt, so that the oxidation reaction of the phenol derivative into the quinomethane type derivative can be rapidly conducted to efficiently obtain the reaction product of the phenol derivative with the sulfinic compound. Therefore, the alumina hydrate is preferred as the pigment used in the receiving layer, with an alumina hydrate having a pseudoboehmite structure being particularly preferred.

As the alumina hydrate used in the present invention, may be suitably utilized that represented by the following general formula (X)

$$Al_2O_{3-n}(OH)_{2n} \cdot mH_2O \quad (X)$$

wherein n denotes any of 0, 1, 2 and 3, and m denotes a value falling within a range of from 0 to 10, preferably from 0 to 5, with the proviso that both m and n are not 0 at the same time. In many cases, $mH_2O$ represents a detachable aqueous phase which does not participate in the formation of a crystal lattice. Therefore, m may take an integer or a value other than integers. When this kind of material is heated, m may reach a value of 0. It is known that the crystal structure of the alumina hydrate is transformed from aluminum hydroxide of the amorphous, gibbsite or boehmite type to aluminum oxide of the γ, σ, η, θ or α type according to the temperature of a heat treatment. In the present invention, that having any of these crystal structures may be used. The alumina hydrate preferred in the present invention is an alumina hydrate showing a beohmite structure or amorphous structure when analyzed by X-ray diffractometry, and examples thereof include the alumina hydrates described in Japanese Patent Application Laid-Open Nos. 7-232473, 8-132731, 9-66664 and 9-76628, and the like.

The pore physical properties of the alumina hydrate are adjusted in the course of the production thereof, and an alumina hydrate having a pore volume of 0.3 to 1.0 ml/g, preferably 0.35 to 0.9 ml/g is preferably used in order to satisfy the BET specific surface area and pore volume of the ink-receiving layer. An alumina hydrate having a pore volume within this range is more preferred in that the pore volume of the resulting ink-receiving layer is controlled within the above-described range. With respect to the BET specific surface area, an alumina hydrate having a BET specific surface area of 50 to 350 $m^2/g$, preferably 100 to 250 $m^2/g$ is preferably used. The alumina hydrate having a BET specific surface area within this range is more preferred in that the BET specific surface area of the resulting ink-receiving layer is controlled within the above-described range. The BET method as stated in the present invention is a surface area measuring method for powder by a vapor-phase adsorption method, which is a method for determining an overall surface area of a sample of 1 g, i.e., a specific surface area, from an adsorption isothermal curve. In general, nitrogen gas is often used as a gas to be adsorbed, and a method that an amount adsorbed is measured from a change of the pressure or volume of the gas to be adsorbed is most often used. The most famous equation representing an isothermal curve of polymolecular adsorption is the Brunauer-Emmett-Teller equation, called a BET equation and widely used in determination of a surface area. An amount adsorbed is found on the basis of the BET equation, and this value is multiplied by an area occupied by an adsorbed molecule on the surface to determine a surface area.

When the total amount of the phenolic compound having the sulfonyl group and the diffusible sulfinic acid salt in the ink-receiving layer is excessive, a print density is lowered to deteriorate printing quality. Therefore, it is preferable that both compounds be not contained too much. In order to achieve a good print density, it is preferable to control the total amount of the phenolic compound having the sulfonyl group and the diffusible sulfinic acid salt to 13% by mass or less based on an inorganic pigment (for example, alumina or silica) making up the porous site. More preferable conditions for preventing decrease in ink recording density are such that this proportion is from 1.5% by mass to 7% by mass. The phenol derivative is preferably added in a proportion of 1 or less in terms of molar ratio to the sulfinic compound. On the other hand, the total amount of the phenolic compound having the sulfonyl group and the diffusible sulfinic acid salt may be suitably determined from the viewpoint of the yellowing-preventing effect. However, it is preferably 1.5% by weight or more based on the alumina in the alumina hydrate in terms of alumina.

The % by mass of the reaction product to the alumina in the alumina hydrate in the ink-fixing region of the ink-receiving layer can be determined in terms of the % by mass of the sulfinic compound or thiosulfonic compound present in the diffusible state in the ink-fixing region based on the alumina hydrate by measurement of the abundance ratio of sulfur and alumina using TOF-SIMS as to a section produced by means of a microtome and from the content of sulfur in the sulfinic compound or reaction product and the content of alumina in the alumina hydrate.

[Support]

No particular limitation is imposed on the support used in the present invention, and any of a water-nonabsorbable support composed of a transparent material such as a plastic and a water-absorbable support composed of an opaque material such as paper may be used. On the other hand, since the period of retaining the yellowing-preventing function depends on the total amount of the phenolic compound having the sulfonyl group and diffusible sulfinic acid salt (for example, sulfinic compound or thiosulfonic compound salt) contained in the recording medium, the water-absorbable support that can diffusibly hold the phenolic compound having the sulfonyl group and the diffusible sulfinic acid salt (sulfinic compound or thiosulfonic compound) without affecting printing quality is preferred.

A water-nonabsorbable support composed of a transparent material or a high-glossy opaque water-nonabsorbable support is preferably used from the viewpoint of making good use of the transparency of the ink-receiving layer that receives and fixes a colorant such as a dye. When the surface of a recording medium is subjected to a cast step to form a glossy surface, a fibrous support, i.e., a water-absorbable support composed of paper, is preferred because water and a solvent component are evaporated from a back surface of the base material. Examples of the water-absorbable support composed of paper include those obtained by subjecting base paper to size press with starch, polyvinyl alcohol or the like, and coated paper obtained by providing a coating layer on base paper, such as art paper, coat paper and cast-coated paper.

When paper is used as the water-absorbable support, it is preferable that a coating layer having such a thickness as completely covers cellulose pulp fiber and texture of the base paper be provided as a primer coating layer of the ink-receiving layer. When no coating layer is provided, coating unevenness (stripe-like defect or the like) caused by the fiber and texture is easy to occur upon coating of the ink-receiving layer, so that the cellulose pulp fiber comes to exist in the ink-receiving layer, or in the vicinity of the surface of the ink-receiving layer, or on the surface thereof. It may thus be difficult in some cases to provide a good and uniform cast surface, i.e., a photograph-like high-glossy surface even when the surface of the recording medium is subjected to a casting treatment. In order to cover the cellulose pulp of the water-absorbable support composed of paper, the dry coating weight of the coating layer is preferably 10 $g/m^2$ or higher, more preferably 15 $g/m^2$ or higher.

When the water-absorbable support composed of paper is used, its Stöckigt sizing degree and Bekk smoothness are preferably controlled to 100 to 400 seconds and 100 to 500 seconds, respectively. In order to provide a recording medium having a feeling of texture and high quality comparable with a silver salt photograph, the basis weight and Gurley stiffness (J. Tappi No. 40, machine direction) of the water-absorbable support composed of paper are preferably controlled to 160 to 230 $g/m^2$ and 7 to 15 mN, respectively.

[Ink-Receiving Layer]

The coating liquid containing alumina hydrate is a coating liquid comprising at least alumina hydrate and a binder, and a crosslinking agent to be added as needed. In the preparation of the coating liquid for the ink-receiving layer, is preferably used a mixing device, in which at least one selected from the group consisting of boric acid and boric acid salts is mixed with an alumina hydrate dispersion, and the resultant mixture is mixed with an aqueous solution of polyvinyl alcohol, which is the binder, right before coating to provide a coating liquid. When such a device is used, increase in viscosity of the coating liquid with time and gelling can be reduced, so that production efficiency can be improved. The solid content concentration of the alumina hydrate in the alumina hydrate dispersion liquid used in the above-described process is preferably 10 to 30% by mass. When the concentration exceeds the upper limit of the above range, the viscosity of the alumina hydrate dispersion liquid becomes high, and the viscosity of the resulting ink-receiving layer also becomes high, so that a problem may arise on on coating ability.

A pigment dispersant, a thickener, a flowability improver, an antifoaming agent, a foam inhibitor, a parting agent, a penetrant, a coloring pigment, a coloring dye, a fluorescent whitening agent, an ultraviolet absorbent, an antioxidant, a preservative, a mildewproofing agent, a water-proofing agent, a dye fixing agent and the like may be suitably contained as other additives in a primer coating layer, which will be described subsequently, and the ink-receiving layer, as needed.

As a preferable binder in the present invention, is preferred a water-soluble resin, with polyvinyl alcohol being particularly preferred. Polyvinyl alcohol having a saponification degree of 70 to 100% is preferred as those preferable. The content of the polyvinyl alcohol is preferably controlled to 5 to 20% by mass based on the alumina hydrate.

As the crosslinking agent preferably used in the present invention, is preferred that capable of causing a crosslinking reaction with the binder to cure the binder. A boron compound is particularly preferred for crosslinking of polyvinyl alcohol. As examples of the boron compound, may be mentioned borax, boric acid, borates (for example, orthoboric acid salts, $InBO_3$, $ScBO_3$, $YBO_3$, $LaBO_3$, $Mg_3(BO_3)_2$ and $Co_3(BO_3)_2$), diborates (for example, $Mg_2B_2O_5$ and $Co_2B_2O_5$), metaborates (for example, $LiBO_2$, $Ca(BO_2)_2$, $NaBO_2$ and $KBO_2$), tetraborates (for example, $NCB_4O_7 \cdot 10H_2O$), and pentaborates (for example, $KB_5O_8 \cdot 4H_2O$, $CCB_6O_{11} \cdot 7H_2O$ and $CsB_5O_5$). Among these, borax, boric acid and borates are preferred in that the crosslinking reaction can be rapidly caused, and boric acid is preferred from the viewpoints of long-term storability of the coating liquid and an effect of inhibiting the occurrence of cracks. The amount of boric acid used is preferably within a range of from 1.0 to 15.0% by mass in terms of solid content of boric acid based on polyvinyl alcohol in the ink-receiving layer.

After the ink-receiving layer containing the sulfinic compound or thiosulfonic compound salt is formed on the support, a glossy surface can be formed on the surface of the ink-receiving layer by a casting method. The production process thereof will be described. The casting method is a method that an ink-receiving layer in a wetted state or a state having plasticity is brought into close contact under pressure with a heated specular drum (cast drum) and dried in this state to copy the specular surface from the drum onto the surface of the ink-receiving layer. Typical methods thereof include 3 methods of a direct method, a rewet method (indirect method) and a solidification method. The use of this wet casting method is preferred because high glossiness is achieved on the surface of the ink-receiving layer.

The coating of the respective coating liquids in the ink-receiving layer, surface treating step and the like is conducted by on-machine coating or off-machine coating using a coating machine suitably selected from various coating machines, for example, a blade coater, a roll coater, an air knife coater, a bar coater, a rod blade coater, a curtain coater, a gravure coater, a coater using an extrusion system, a coater using a slide hopper system and a size press, so as to give a proper coating weight. Upon the coating, each coating liquid may also be heated for the purpose of adjusting the viscosity of the coating liquid. A coater head may also be heated. Upon drying after the coating, for example, a hot air dryer such as a linear tunnel dryer, an arch dryer, an air loop dryer or a sine curve air float dryer, an infrared heating dryer, or a dryer utilizing a microwave or the like may be suitably chosen for use.

In order to achieve objects and effects such as high ink absorbency and high fixability, the pore physical properties preferably satisfy the following conditions. First, the pore volume of the ink-receiving layer preferably falls within a range of from 0.1 to 1.0 $cm^3/g$. In other words, if the pore volume is smaller than the lower limit of the above range, sufficient ink-absorbing performance is not achieved, and the resulting ink-receiving layer is poor in ink absorbency. In some cases, there may be a possibility that ink overflowing may occur to cause bleeding on an image formed. If the pore volume exceeds the upper limit of the above range on the other hand, there is a tendency for the resulting ink-receiving layer to easily cause cracking and powdery coming-off. The BET specific surface area of the ink-receiving layer is preferably 20 to 450 $m^2/g$. If the specific surface area is smaller than the lower limit of the above range, sufficient glossiness may not be achieved in some cases. In addition, there is a possibility that white mist may appear on an image itself because haze is increased (transparency is lowered). In this case, there is also a possibility that the ability to adsorb a dye in an ink may be lowered. Thus, the specific surface area smaller than the lower limit is not preferred. If the specific surface area exceeds the upper limit of the above range on the other hand, such an ink-receiving layer is easy to cause cracking. Thus, the specific surface area exceeding the upper limit is not preferred. Incidentally, the pore volume and BET specific surface area can be determined by the nitrogen adsorption and desorption method.

The dry coating weight of the ink-receiving layer is preferably controlled to 30 to 50 $g/m^2$. If the dry coating weight is smaller than the lower limit of the above range, sufficient ink absorbency may not be achieved in some cases, namely, ink overflowing may occur to cause bleeding, or a dye in the ink may diffuse up to the base material to lower a print density, when the resulting recording medium is used in a printer to which a plurality of light shade inks are added in addition to 3 color inks of cyan, magenta and yellow, and a black ink. Thus, the dry coating weight smaller than the lower limit is not preferred. If the dry coating weight exceeds the upper limit of the above range on the other hand, there is a possibility that the occurrence of cracking may not be prevented. When the dry coating weight is greater than 30 $g/m^2$, the resulting ink-receiving layer exhibits sufficient ink absorbency even under a high-temperature and high-humidity environment. Thus, such a dry coating weight is preferred. When the dry coating weight is not greater than 50 $g/m^2$, the resulting ink-receiving layer is hard to cause coating unevenness, whereby an ink-receiving layer having a stable thickness can be produced.

A colorant deterioration inhibitor may also be added to the ink-jet recording medium according to the present invention. The colorant deterioration inhibitor means a compound that protects a dye from factors deteriorating the dye, such as gasses and light, to improve the weatherability of the dye when it is present together with the dye in the ink-receiving layer. General examples thereof include hindered amine compounds, hindered phenol compounds, benzophenone compounds, benzotriazole compounds, thiourea compounds, thiuram compounds and phosphite compounds, and the hindered amine compounds are particularly preferably used. However, the colorant deterioration inhibitors are not limited thereto.

The content of the hindered amine in the ink-receiving layer is preferably within a range of from 0.5 to 10% by mass based on the solid content of the pigment. When the content is controlled to the above lower limit or higher, a sufficient inhibitory effect on fading is achieved. When the content is controlled to the above upper limit or lower, lowering of the ink absorbency can be prevented.

In the present invention, the colorant deterioration inhibitor is preferably added into the receiving layer by dissolving it in a solvent and applying the solution thus prepared to the receiving layer formed by overcoating. The solvent dissolving the colorant deterioration inhibitor therein may be any solvent so far as it can dissolve the colorant deterioration inhibitor therein, and various kinds of solvents may be used. No particular limitation is imposed on organic solvents, and examples thereof include esters such as ethyl acetate and butyl acetate, ketones such as methyl isobutyl ketone, methyl ethyl ketone and acetone, ethers such as diethyl ether and ethyl methyl ether, and alcohols such as isopropanol, methanol and ethanol. The sulfinic compound or thiosulfonic compound salt may be dissolved in the overcoating liquid containing the colorant deterioration inhibitor to add the sulfinic compound or thiosulfonic compound to the receiving layer in the overcoating step. A mixed solvent using a plurality of solvents may be used in dissolution of the colorant deterioration inhibitor and the sulfinic compound or thiosulfonic compound salt.

According to the production process of the present invention as described above, the phenolic compound having the sulfonyl group and the diffusible sulfinic acid salt can be caused to coexist in the ink-receiving layer.

EXAMPLES

The present invention will hereinafter be described more specifically by the following EXAMPLES and COMPARATIVE EXAMPLES mentioning examples satisfying relational conditions shown in Table 1. However, the present invention is not limited to these examples. First, measuring methods of various physical property values, and evaluation methods, which were used in the present invention, are described.

<Physical Distribution and Storage>

There was used a storing method under storage conditions equivalent to a storage environment corresponding to a period (physical distribution period) from production of recording media to delivery of the products to stores. The physical distribution and storage conditions correspond to conditions under which products were transported to Amsterdam by marine transport after their production in Japan. As a storing method, was used a system that recording media are placed in a PET film container to store them for 10 days under an environment of 50° C. and 80% RH. At this time, evaluation as to yellowing of white portions upon storage in a file was made by using a density difference between a measured result of a 50 mm×10 mm white portion of the specimen exposed from a resin file by means of a spectrophotometer, Spectrolino(manufactured by Gretag Macbeth Co.) and the density of the white portion before the storage to evaluate yellowing level of the white portion.

White portion yellowing level ($\Delta b^*$)=($b^*$ before storage)−($b^*$ after storage).

A: $\Delta b^* \leqq 2$; good level that yellowing is not visually observed,

B: $2 < \Delta b^* \leqq 3$; level that yellowing is not visually conspicuous at all, C: $3 < \Delta b^* \leqq 6$; level that yellowing is visually observed, but actual use is still feasible.

<Evaluation as to Yellowing of White Portion Upon Exposure to BHT>

The used evaluation method was a method that an unprinted specimen of 25 mm×200 mm is stored for 260 hours at 50° C. in a tubular sample bottle (opening: 27 mm, depth: 120 mm) in which 5 g of 2,6-di-t-butyl-p-methylphenol (BHT) has been contained, in a state that the specimen has been exposed by 80 mm from the tubular sample bottle. The above storing conditions are accelerated deterioration test conditions corresponding to the storage for 1.5 years in a resin file. At this time, evaluation as to yellowing of a white portion upon storage in a file was made by using a density difference between a measured result of a 50 mm×10 mm white portion of the specimen exposed from the resin file by means of a spectrophotometer, Spectrolino(manufactured by Gretag Macbeth Co.) and a density of the white portion before the storage to evaluate a yellowing level of the white portion.

White portion yellowing level ($\Delta b^*$)=($b^*$ before storage)−($b^*$ after storage)

A: $\Delta b^* \leqq 1$; good level that yellowing is not visually observed,

B: $\Delta b^* \leqq 2$; level that yellowing is not visually conspicuous at all, C: $2 < \Delta b^* \leqq 3$; level that yellowing is visually observed, and actual use is infeasible.

<Evaluation as to Print Density>

After solid printed batches of 100% duty were printed on the recording surfaces of the respective recording media with black, cyan, magenta and yellow inks by means of a photoprinter (trade name: PIXUS 950i, manufacture by Canon Inc.) using an ink-jet system and stored for 3 days under an environment of 25° C. and 50% RH, colorimetry was conducted by means of a spectrophotometer, Spectrolino(manufactured by Gretag Macbeth Co.) to evaluate OD value.

A: OD value is 2.20 or higher, gradation reproduction property at high-density portions is very good, being highly useful, B: level that the OD value is not lower than 2.10, but lower than 2.20, and gradation reproduction property at high-density portions is poorer than 'A', but causing no problem in actual use, C: level that the OD value is not lower than 2.00, but lower than 2.10, and gradation reproduction property at high-density portions is low, but being still feasible in actual use.

Incidentally, samples yellowed after the physical distribution and storage and samples yellowed in the evaluation as to yellowing of white portions upon exposure to BHT were at a level infeasible in actual use, so that the evaluation as to print density was not made.

Example 1

<Preparation of Reaction Product>

After sodium p-toluenesulfinate adjusted to pH 7.0 with 0.1N nitric acid was dissolved in ion-exchanged water in a three-necked flask, 100 g of a 0.22 mol solution of sodium p-toluenesulfinate adjusted to pH 7.0 with 0.1N nitric acid and 100 g of a solution with 2,6-di-t-butyl-4-hydroxymethylphenol dissolved in ethanol so as to give a concentration of 0.2 mol were mixed, the solution prepared in the following manner was added to the resultant mixture, and the mixture was heated for 20 hours under reflux at 80° C. while introducing air passed through a ball filter, thereby obtaining a reaction product. The reaction product was analyzed by HPLC, thereby confirming that the peak of 2,6-di-t-butyl-4-hydroxymethylphenol has disappeared, and the reaction of p-toluenesulfinic acid with 2,6-di-t-butyl-4-hydroxymethylphenol had been completed.

<Production of Support>

A support was first produced in the following manner. After 0.60 part by mass of cationized starch, 10 parts by mass of heavy calcium carbonate, 15 parts by mass of precipitated calcium carbonate, 0.10 part by mass of an alkyl ketene dimmer and 0.03 part by mass of cationic polyacrylamide were externally added to a pulp slurry composed of 80 parts by mass of Laulholz (deciduous) bleached kraft pulp (LBKP) having a freeness of 450 ml CSF (Canadian Standard Freeness) and 20 parts by mass of Nadelholz (coniferous) bleached kraft pulp (NBKP) having a freeness of 480 ml CSF to prepare a paper stock, then paper was made by means of a Fourdrinear paper machine, being subjected to 3-stage wet pressing and dried by a multi-cylinder dryer. Thereafter, the paper was then impregnated with an aqueous solution of oxidized starch to give a concentration of 1.0 g/m$^2$ in terms of solid content and dried, the thus-treated paper was subjected to calender machine finishing to obtain a support having a basis weight of 155 g/m$^2$, a Stöckigt sizing degree of 100 seconds, an air permeability of 50 seconds, a Bekk smoothness of 30 seconds and a Gurley stiffness of 11.0 mN.

A primer coating layer was then formed on the support obtained above in the following manner. As a coating liquid used in the formation of the primer coating layer, a composition was first obtained by adding 7 parts by mass of a commercially available styrene-butadiene latex to a slurry of a solid content concentration of 70% by mass composed of 100 parts by mass of a loading material containing kaolin (Ultrawhite 90, product of Engelhard Co.)/zinc oxide/alumina hydroxide at a weight ratio of 65/10/25, and 0.1 part by mass of a commercially available polyacrylic acid dispersant and adjusting the resultant mixture so as to give a solid content of 60% bymass. This composition was then applied on to both surfaces of the support by a blade coater so as to give a dry coating weight of 15 g/m$^2$, and dried. The thus-treated support was then subjected to calender machine finishing (linear pressure: 150 kgf/cm) to obtain a primer-coated support having a basis weight of 185 g/m$^2$, a Stöckigt sizing degree of 300 seconds, an air permeability of 3,000 seconds, a Bekk smoothness of 200 seconds and a Gurley stiffness of 11.5 mN. The whiteness degree of the primer-coated support was determined by conducting measurement as to 5 A4-sized samples cut out of the support to find the average value thereof. As a result, the whiteness degree was L*: 95, a*: 0, b*: −2 (determined as a hue in accordance with JIS Z 8729).

(Surface Treatment Step)

The primer coating layer obtained above was subjected to surface treatment comprising the following steps. A precoating liquid having the following composition, which was warmed to 30° C., was applied on to the primer coating layer at a rate of 30 m/min by an air knife coater so as to give a wet coating weight of 16 g/m$^2$ (0.8 g/m$^2$ in terms of dry coating weight).

(Precoating Liquid)

Sodium tetraborate: 5 g

Isopropanol: 0.15 g

Ion-exchanged water was added so as to obtain the total weight of 100 g.

(Coating Step of Applying Liquid Containing Alumina Hydrate, Binder and Crosslinking Agent: Step B)

An ink-receiving layer was then formed. After the coating in the above-described surface treating step, i.e., immediately after the primer coating layer was impregnated with the coating liquid, the ink-receiving layer was directly formed on the primer coating layer. At this time, the coating liquid and the coating method used in the forming of the ink-receiving layer are as follows.

An alumina hydrate A of Disperal HP13 (product of SASOL Co.) was dispersed in water (preferably, pure water for a countermeasure against contaminants in the alumina) so as to give a solid content of 5% by mass, hydrochloric acid was then added to the dispersion liquid to adjust it to pH 4, and the thus-adjusted dispersion liquid was stirred for a while. The dispersion liquid was then heated to 95° C. while stirring it, and held for 4 hours at this temperature. The pH value of the dispersion liquid was adjusted to 10 with caustic soda while keeping this temperature, followed by stirring for 10 hours. Thereafter, the temperature of the dispersion liquid was returned to room temperature, and its pH was adjusted to 7 to 8. A desalting treatment was then conducted, and acetic acid was added to conduct a deflocculation treatment, thereby obtaining a colloidal sol. This colloidal sol was dried, and the resultant alumina hydrate B was measured by X-ray diffraction and found to have a pseudoboehmite structure. The BET specific surface area and pore volume of this alumina hydrate were 143 m$^2$/g and 0.8 cm$^3$/g, respectively, and the form thereof was a flat plate as determined by observation through an electron microscope. The alumina content in the alumina hydrate used was from 70% by mass to 80% by mass.

On the other hand, polyvinyl alcohol, PVA17 (product of Kuraray Co., Ltd.) was dissolved in ion-exchanged water to obtain an aqueous solution having a solid content of 9% by mass. The colloidal sol of the alumina hydrate B prepared above was concentrated to prepare a 22.5% by mass dispersion liquid, and a 3% aqueous solution of boric acid was then added to the dispersion liquid in such a manner that the content of boric acid becomes 0.50% by mass, in terms of solid content, based on the solid content of the alumina hydrate B. The thus-obtained boric acid containing alumina hydrate dispersion liquid and the aqueous solution of polyvinyl alcohol previously prepared were mixed by a static mixture so as to give a mixing ratio of the alumina hydrate to polyvinyl alcohol of 100:8 in terms of solid content. Right after the mixing, the resultant mixture was used as a coating liquid for an ink-receiving layer and applied at a rate of 30 m/min by a die coater so as to give a dry coating weight of 35 g/m$^2$. The coating layer was then dried at 170° C. to form an ink-receiving layer.

(Overcoating Step)

The following overcoating liquid was then applied at a rate of 30 m/min by a die coater so as to give a coating weight of 26.4 g/m$^2$ in such a manner that the reaction product obtained in the preparation of the reaction product amounts to 2.64 mmol/m$^2$ in terms of the phenol derivative used in the reaction. The resultant coating layer was dried at 120° C. to form an ink-receiving layer. Thereafter, 0.01N nitric acid and a 0.01N sodium hydroxide solution were used to adjust the surface and internal pHs of the ink-receiving layer to 6.2.

(Formulation of Overcoating Liquid)

Reaction product 5 g

Ion-exchanged water was added so as to obtain the total weight of 100 g.

<Formation of Back Surface>

A back surface layer was then formed on the primer coating layer on the surface of the support that is opposite to the one on which the ink-receiving layer was provided in the following manner. An alumina hydrate of Disperal HP13/2 (product of SASOL Co.) was dispersed in water (preferably, pure water for a countermeasure against contaminants in the alumina) so as to give a solid content of 18% by mass, and the resultant dispersion liquid was then subjected to a centrifugal treatment. This dispersion liquid and the same aqueous solution of polyvinyl alcohol as used in the forming of the ink-receiving layer were mixed by a static mixer so as to give a mixing ratio of the alumina hydrate to polyvinyl alcohol of 100:9 in terms of solid content. Thereafter, the resultant mixture was immediately applied at a rate of 35 m/min by a die coater so as to give a dry coating weight of 23 g/m$^2$. The coating layer was then dried at 170° C. to form a back surface layer, thereby obtaining a recording medium.

Example 2

A recording medium was produced in the same manner as in EXAMPLE 1 except that the concentration of the sodium p-toluenesulfinate solution was changed to 0.24 mol/l upon the preparation of the reaction product in EXAMPLE 1.

Example 3

A recording medium was produced in the same manner as in EXAMPLE 1 except that the concentration of the sodium p-toluenesulfinate solution was changed to 0.8 mol/l upon the preparation of the reaction product in EXAMPLE 1.

Example 4

A recording medium was produced in the same manner as in EXAMPLE 1 except that the concentration of the sodium p-toluenesulfinate solution was changed to 2.0 mol/l upon the preparation of the reaction product in EXAMPLE 1.

Example 5

A recording medium was produced in the same manner as in EXAMPLE 1 except that the concentration of the sodium p-toluenesulfinate solution was changed to 0.88 mol/l and the concentration of the 2,6-di-t-butyl-4-hydroxymethylphenol solution was changed to 0.8 mol/l upon the preparation of the reaction product in EXAMPLE 1.

Example 6

A recording medium was produced in the same manner as in EXAMPLE 1 except that the concentration of the sodium p-toluenesulfinate solution was changed to 2.2 mol/l and the concentration of the 2,6-di-t-butyl-4-hydroxymethylphenol solution was changed to 2 mol/l upon the preparation of the reaction product in EXAMPLE 1.

Example 7

A recording medium was produced in the same manner as in EXAMPLE 1 except that 0.01N nitric acid was used in the overcoating step of EXAMPLE 1 to adjust the surface and internal pHs of the ink-receiving layer to 5.0.

Example 8

A recording medium was produced in the same manner as in EXAMPLE 1 except that a 0.01N NaOH solution was used in the overcoating step of EXAMPLE 1 to adjust the surface and internal pHs of the ink-receiving layer to 7.5.

Example 9

A recording medium was produced in the same manner as in EXAMPLE 1 except that a 0.01N NaOH solution was used in the overcoating step of EXAMPLE 1 to adjust the surface and internal pHs of the ink-receiving layer to 8.5.

Example 10

A recording medium was produced in the same manner as in EXAMPLE 1 except that sodium p-toluenesulfinate in EXAMPLE 1 was changed to sodium benzenesulfinate.

Example 11

A recording medium was produced in the same manner as in EXAMPLE 1 except that 2,6-di-t-butyl-4-hydroxymethylphenol in EXAMPLE 1 was changed to 2-t-butyl-4,6-dimethylphenol.

Example 12

A recording medium was produced in the same manner as in EXAMPLE 1 except that 2,6-di-t-butyl-4-hydroxymethylphenol in EXAMPLE 1 was changed to 2,4-di-t-butylphenol.

Example 13

A recording medium was produced in the same manner as in EXAMPLE 3 except that 2,6-di-t-butyl-4-hydroxymethylphenol in EXAMPLE 3 was changed to 2,2'-methylene-bis (4-methyl-6-t-butylphenol).

Example 14

A recording medium was produced in the same manner as in EXAMPLE 3 except that no reaction product prepared in the overcoating step of EXAMPLE 1 was applied, but a 0.11 mol/l sodium p-toluenesulfinate solution and 0.1 mol/l of 2,6-di-t-butyl-4-hydroxymethylphenol were applied at a rate of 30 m/min by a die coater so as to each give a coating weight of 26.4 g/m$^2$, the resultant coating layer was then dried at room temperature, the thus-treated support was then subjected to a heat treatment at 50° C. for 20 hours in an oven while introducing air to form an ink-receiving layer, and thereafter, 0.01N nitric acid and a 0.01N sodium hydroxide solution were used to adjust the surface and internal pHs of the ink-receiving layer to 6.2.

Example 15

A recording medium was produced in the same manner as in EXAMPLE 14 except that the sample after the drying at room temperature in EXAMPLE 14 was hermetically sealed in a container composed of a PET film to conduct a heat treatment at 50° C. for 20 hours in an oven.

Example 16

A sample (sample A) produced in the same manner as in COMPARATIVE EXAMPLE 1, which will be described subsequently, except that a 0.11 mol/l sodium p-toluenesulfinate solution was applied on to the ink-receiving layer formed in COMPARATIVE EXAMPLE 1, and the resultant coating layer was then dried at room temperature, and a sample (sample B) obtained by applying an ethanol solution of 2,6-di-t-butyl-4-hydroxymethylphenol on to a back surface of a recording medium produced in COMPARATIVE EXAMPLE 1 in such a manner that 0.35 mmol/$m^2$ of 2,6-di-t-butyl-4-hydroxymethylphenol exists and then drying the coating layer at room temperature were produced. After both samples were hermetically sealed in a container composed of a PET film in such a mutually overlapped state that a front surface of the sample A and a back surface of the sample B became in contact with each other, a heat treatment was conducted at 50° C. for 20 hours in an oven while introducing air. The sample A was used in the evaluation.

Example 17

After a sample produced in the same manner as in COMPARATIVE EXAMPLE 1, which will be described subsequently, except that a 0.11 mol/l sodium p-toluenesulfinate solution was applied on to the ink-receiving layer formed in COMPARATIVE EXAMPLE 1, and the resultant coating layer was then dried at room temperature was hermetically sealed in a container composed of a PET film containing 2,6-di-t-butyl-4-hydroxymethylphenol in a proportion of 0.035 mmol/$m^2$, a heat treatment was conducted at 50° C. for 20 hours by means of an oven while introducing air.

Example 18

A recording medium was produced in the same manner as in COMPARATIVE EXAMPLE 1 except that a 0.11 mol/l sodium p-toluenesulfinate solution was applied on to the ink-receiving layer formed in COMPARATIVE EXAMPLE 1, and cut into an A4 size. An image having a white margin was printed on the thus-obtained sample by means of PIXUS 950i manufactured by Canon Inc. after the resultant print was hermetically sealed in a container composed of a PET film containing 2,6-di-t-butyl-4-hydroxymethylphenol in a proportion of 0.035 mmol/$m^2$, a heat treatment was conducted at 50° C. for 20 hours by means of an oven while introducing air.

An unprinted portion and a white margin portion were used in evaluation of this sample.

Comparative Example 1

A recording medium was produced in the same manner as in EXAMPLE 1 except that the step of applying the overcoating liquid was omitted.

Comparative Example 2

A recording medium was produced in the same manner as in EXAMPLE 1 except that the reaction product in the overcoating liquid in EXAMPLE 1 was changed to 0.0022 mol/g of sodium p-toluenesulfinate to form an ink-receiving layer, and 0.1N hydrochloric acid was then applied to adjust the surface pH of the ink-receiving layer to 4.0.

Comparative Example 3

A recording medium was produced in the same manner as in EXAMPLE 1 except that the reaction product in the overcoating liquid in EXAMPLE 1 was changed to 0.0022 mol/g of 4-sulfomethylphenol.

The results of EXAMPLES and COMPARATIVE EXAMPLES are shown below.

TABLE 1

| | Molar ratio upon synthesis | Surface pH | Content Reaction product + sulfinic acid (% to receiving layer) | Reaction product (% to receiving layer) | Content Sulfinic acid (% to receiving layer) | Evaluation of yellowing | Evaluation of yellowing after physical distribution | Print density |
|---|---|---|---|---|---|---|---|---|
| EX. 1 | 1.10 | 6.20 | 3.02% | 2.89% | 0.13% | A | A | A |
| EX. 2 | 1.20 | 6.20 | 3.16% | 2.89% | 0.27% | A | A | A |
| EX. 3 | 4.00 | 6.20 | 6.92% | 2.89% | 4.03% | A | A | A |
| EX. 4 | 10.00 | 6.20 | 14.97% | 2.89% | 12.08% | A | A | C |
| EX. 5 | 1.10 | 6.20 | 12.09% | 11.56% | 0.54% | A | A | B |
| EX. 6 | 1.10 | 6.20 | 30.23% | 28.89% | 1.34% | A | A | C |
| EX. 7 | 1.10 | 5.00 | 3.02% | 2.89% | 0.13% | A | A | A |
| EX. 8 | 1.10 | 7.50 | 3.02% | 2.89% | 0.13% | A | A | A |
| EX. 9 | 1.10 | 8.50 | 3.02% | 2.89% | 0.13% | B | B | A |
| EX. 10 | 1.10 | 6.20 | 3.01% | 2.89% | 0.12% | A | A | A |
| EX. 11 | 1.10 | 6.20 | 2.90% | 2.77% | 0.13% | A | A | A |
| EX. 12 | 1.10 | 6.20 | 2.59% | 2.45% | 0.13% | A | A | A |
| EX. 13 | 1.10 | 6.20 | 3.87% | 3.73% | 0.13% | A | A | A |
| EX. 14 | 1.10 | 6.20 | 1.51% | 1.44% | 0.07% | B | B | A |
| EX. 15 | 1.10 | 6.20 | 1.51% | 1.44% | 0.07% | B | B | A |
| EX. 16 | 1.10 | 6.20 | 1.51% | 1.44% | 0.07% | B | B | A |
| EX. 17 | 1.10 | 6.20 | 1.51% | 1.44% | 0.07% | B | B | A |
| EX. 18 | 1.10 | 6.20 | 1.51% | 1.44% | 0.07% | B | B | A |
| COMP. EX. 1 | — | 6.20 | 0.00% | 0.00% | 0.00% | C | C | — |

TABLE 1-continued

| | Molar ratio upon synthesis | Surface pH | Content Reaction product + sulfinic acid (% to receiving layer) | Reaction product (% to receiving layer) | Content Sulfinic acid (% to receiving layer) | Evaluation of yellowing | Evaluation of yellowing after physical distribution | Print density |
|---|---|---|---|---|---|---|---|---|
| COMP. EX. 2 | — | 4.00 | 3.02% | 0.00% | 3.02% | C | C | — |
| COMP. EX. 3 | — | 6.20 | 3.02% | 3.03% | 0.00% | C | C | — |

The "phenol derivatives" stated in the present invention achieve the same reaction and effect as those used in EXAMPLES so far as they are phenol derivatives having a similar structure to those derivatives and having electron-donating groups at ortho-and para-positions as used as a stabilizer for resins. In EXAMPLES, typical derivatives among the phenol derivatives were used. In EXAMPLES 1 to 18, "the phenolic compounds having the sulfonyl group and the diffusible sulfinic acid salt", which are reaction products of a sulfinic compound with a phenol derivative, coexist in the ink-receiving layer, and their yellowing-preventing effects attribute to a synergistic effect of the sulfinic compound and the reaction product.

When the sulfinic compound and phenol derivative are separately added, the presence of a remaining phenol derivative component in the recording medium right after production may be determined to find out whether the reaction product is formed or not. As for a specific method, the recording medium right after production is immersed in an ethanol solution at room temperature for 30 minutes to extract components in the ink-receiving layer, and whether the phenol derivative is present or not is analyzed by HPLC. At this time, it was acknowledged that the phenolic compound having the sulfonyl group was obtained as a reaction product by the reaction with the sulfinic compound unless the quinomethane type derivative and phenol derivative are detected. When these compounds were detected, it was acknowledged that no reaction took place, and both sulfinic compound and phenol derivative were present. With respect to other samples than those described above, the evaluation was performed. As a result, it was found as the cause for the case where no reaction product of the sulfinic compound with the phenol derivative is formed in spite of the same conditions used except the pH of the ink-receiving layer that the reactivity of the phenol derivative is lowered and the sulfinic compound comes to exist as a free acid undiffusible depending on external factors such as humidity if the pH of the ink-receiving layer is too low, so that the reaction is hard to take place. Therefore, the reaction is preferably performed under the above-described conditions.

With respect to the structure of the reaction product component in this extract, the structure was identified by means of NMR. As a result, it could be confirmed that the component has the structure of the general formula (I) or (II). In other words, it was confirmed that in the constitution according to the present invention that "the phenolic compound having the sulfonyl group and the diffusible sulfinic acid salt" coexist, the reaction product of the sulfinic compound with the phenol derivative has the structure of the general formula (I) or (II).

The measurement of the surface and internal pHs of the ink-receiving layers obtained above was conducted in accordance with the method A (coating method) among the surface and internal pH measurements prescribed by Japan Technical Association of the Pulp and Paper Industry (J. TAPPI). A pH measuring kit (model MPC) for paper surface manufactured by KYORITSU CHEMICAL-CHECK Lab. corresponding to the method A was used to measure the surface and internal pHs of the ink-receiving layers. The internal pHs of the ink-receiving layers were measured by observing a section produced by a microtome after the measurement of the surface and internal pHs through a microscope to confirm that the internal pH of each ink-receiving layer is the same as the surface and internal pHs of the ink-receiving layer by the findings that a coating liquid of the measuring kit completely penetrates into the ink-receiving layer, and that the ink-receiving layer is uniformly colored without causing color unevenness within a range from the recording surface to the support.

According to the technical idea of the present invention, a long-term excellent yellowing-preventing effect can be achieved by introducing the reaction product of the sulfinic compound with the phenol derivative into an article having such micropores that BHT is adsorbed. In view of this fact, it can be sufficiently understood by a person skilled in the art that the applications of the present invention can be developed to many fields, and the present invention can be applied to other microporous substances than the alumina hydrate and various kinds of articles.

The present invention can surely achieve the yellowing-preventing effect, which has heretofore been unable to be achieved, by the constitutive requirement typified by the article in which the phenolic compound having the sulfonyl group and the diffusible sulfinic acid salt are caused to coexist, and the efficacy thereof can be stably retained over a long period of time.

Accordingly, according to the aspect (1), the effect of preventing yellowing of the article can be stably exhibited from the beginning over a long period of time, and the long-term retention of white portions in the article can be achieved. According to the aspect (2), the white color-retaining effect of the medium itself subjected to ink recording can be exhibited, and the effect of preventing yellowing of white portions can be retained even when the ink recording medium is stored in a resin file for a long period of time after it is subjected to the ink recording. According to the aspect (3), the performance of preventing yellowing caused in a physical distribution and storage period required until the ink-jet recording medium is transported overseas by marine transport after its production can be retained, and moreover the effect of preventing yellowing of white portions after printing can be retained. All the aspects (6) to (9) can provide a production process capable of efficiently producing a recording medium having the above-described effect of preventing yellowing of white portions. According to the aspect (4), by which the third object can be solved, an effect of suppressing the lowering of a print density is brought about in addition to the long-term and high-reliability yellowing-preventing effect. According to the aspect (5), storage of images over a long period of time and prevention of yellowing of white portions upon storage in a file can be achieved without lowing a print density and impairing print quality after printing, and so the yellowing-preventing effect is brought about both in a physical distribution and storage period and upon storage in a file. According to the aspects (10) and (11), articles excellent in the yellowing-preventing effect can be provided even when the articles have a porous portion.

This application claims priority from Japanese Patent Application No. 2004-336606 filed Nov. 19, 2004, which is hereby incorporated by reference herein.

What is claimed is:

1. An ink recording medium comprising an ink-receiving layer of a microporous structure formed on a support, wherein the ink-receiving layer has a phenolic compound having a sulfonyl group and a diffusible sulfinic acid salt, the phenolic compound having a sulfonyl group being at least one selected from a compound represented by the following general formula (I) and a compound represented by the following general formula (II):

(I)

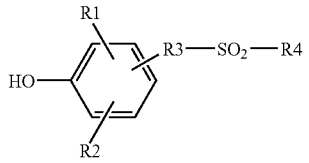

wherein R1 and R2 are individually hydrogen, a substituted or unsubstituted and linear, branched, or cyclic alkyl group (having 1 to 30 carbon atoms), an alkoxy group (having 1 to 20 carbon atoms), a substituted or unsubstituted aryl group (having 6 to 30 carbon atoms), a mono-or di-substituted amino group (the substituent group(s) being an alkyl, acyl or alkenyl group having 1 to 20 carbon atoms), sulfide, disulfide, an amide group, an ester group, an alkenyl group, a hydroxyl group, or a substituted or unsubstituted ureido group (having 1 to 20 carbon atoms) and may form a bis form, with the proviso that both R1 and R2 are not hydrogen at the same time, at least one of R1 and R2, which is not hydrogen, is located at an o-position, and these functional groups may have an additional substituent, R3 is a substituted or unsubstituted and saturated or unsaturated alkylene group having 1 to 30 carbon atoms, a carbonyl group or a thiocarbonyl group, and R4 is a saturated alkyl, alkoxy, or alkenyl group, a substituted or unsubstituted aryl group, or a substituted or unsubstituted aryloxy group, with the proviso that these functional groups may be substituted by a hydroxy, amino, carboxyl, alkoxy, alkenyl, or alkyl group, (II)

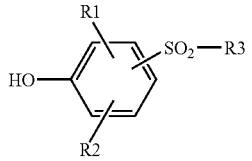

wherein R1 and R2 are individually hydrogen, a substituted or unsubstituted and linear, branched, or cyclic alkyl group (having 1 to 30 carbon atoms), an alkoxy group (having 1 to 20 carbon atoms), a substituted or unsubstituted aryl group (having 6 to 30 carbon atoms), a mono-or di-substituted amino group (the substituent group(s) being alkyl, acyl, or alkenyl group having 1 to 20 carbon atoms), sulfide, disulfide, an amide group, an ester group, an alkoxy group, an alkenyl group, a hydroxyl group, or a substituted or unsubstituted ureido group (having 1 to 20 carbon atoms) and may form a bis form, with the proviso that both R1 and R2 are not hydrogen at the same time, at least one of R1 and R2, which is not hydrogen, is located at an o-position, and these functional groups may have an additional substituent, and R3 is a saturated alkyl, alkoxy, or alkenyl group, a substituted or unsubstituted aryl group, or a substituted or unsubstituted aryloxy group, with the proviso that these functional groups may be substituted by a hydroxy, amino, carboxyl, alkoxy, alkenyl, or alkyl group.

2. The ink-jet recording medium according to claim 1, wherein the surface pH and internal pH of the ink-receiving layer are each from 5.0 to 8.5.

3. The ink-jet recording medium according to claim 2, wherein the total amount of the phenolic compound having a sulfonyl group and the diffusible sulfinic acid salt is from 1.5% by mass to 13.0% by mass based on an inorganic pigment making up the microporous structure.

4. The ink-jet recording medium according to claim 2, wherein the total amount of the phenolic compound having a sulfonyl group and the diffusible sulfinic acid salt is from 1.5% by mass to 7.0% by mass based on an inorganic pigment making up the microporous structure.

5. An ink recording medium comprising an ink-receiving layer of a microporous structure formed on a support, wherein the ink-receiving layer has a phenolic compound having a sulfonyl group and a diffusible sulfinic acid salt, the phenolic compound having a sulfonyl group being at least one selected from a compound represented by the following general formula (I) and a compound represented by the following general formula (II):

(I)

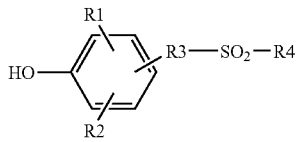

wherein R1 and R2 are individually hydrogen, a substituted or unsubstituted and linear, branched, or cyclic alkyl group (having 1 to 30 carbon atoms), an alkoxy group (having 1 to 20 carbon atoms), a substituted or unsubstituted aryl group (having 6 to 30 carbon atoms), sulfide, disulfide, an amide group, an ester group, an alkenyl group, a hydroxyl group, or a substituted or unsubstituted ureido group (having 1 to 20 carbon atoms) and may form a bis form, with the proviso that both R1 and R2 are not hydrogen at the same time, at least one of R1 and R2, which is not hydrogen, is located at an o-position, and these functional groups may have an additional substituent, R3 is a substituted or unsubstituted and saturated and unsaturated alkylene group having 1 to 30 carbon atoms, a carbonyl group or a thiocarbonyl group, and R4 is a saturated alkyl, alkoxy, or alkenyl group, a substituted or unsubstituted aryl group, or a substituted or unsubstituted aryloxy group, with the proviso that these functional groups may be substituted by a hydroxy, amino, carboxyl, alkoxy, alkenyl, or alkyl group, (II)

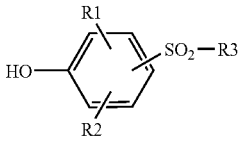

wherein R1 and R2 are individually hydrogen, a substituted or unsubstituted and linear, branched, or cyclic alkyl group (having 1 to 30 carbon atoms), an alkoxy group (having 1 to 20 carbon atoms), a substituted or unsubstituted aryl group (having 6 to 30 carbon atoms), sulfide, disulfide, an amide group, an ester group, an alkoxy group, an alkenyl group, a hydroxyl group, or a substituted or unsubstituted ureido group (having 1 to 20 carbon atoms) and may form a bis form, with the proviso that both R1 and R2 are not hydrogen at the same time, at least one of R1 and R2, which is not hydrogen, is located at an o-position, and these functional groups may have an additional substituent, and R3 is a saturated alkyl, alkoxy, or alkenyl group, a substituted or unsubstituted aryl group, or a substituted or unsubstituted aryloxy group, with the proviso that these functional groups may be substituted by a hydroxy, amino, carboxyl, alkoxy, alkenyl, or alkyl group.

* * * * *